United States Patent [19]

Introvigne

[11] 4,390,761

[45] Jun. 28, 1983

[54] HIGH CURRENT SWITCHING

[75] Inventor: Angelo J. Introvigne, Stafford Springs, Conn.

[73] Assignee: Cole Hersee Company, South Boston, Mass.

[21] Appl. No.: 226,079

[22] Filed: Jan. 19, 1981

[51] Int. Cl.[3] ..... H01H 21/00

[52] U.S. Cl. ..... 200/67 C; 200/11 J; 200/65

[58] Field of Search ..... 200/11 R, 11 A, 11 B, 200/11 C, 11 D, 11 DA, 11 E, 11 EA, 11 G, 11 H, 11 J, 11 K, 11 TC, 11 TW, 67 C, 153 SC, 155 R, 63 R, 65, 66, 255, 254, 15, 70, 162

[56] References Cited

U.S. PATENT DOCUMENTS

| | | | |
|---|---|---|---|
| 554,221 | 2/1896 | Hart | 200/66 |
| 638,199 | 11/1899 | Merrick | 200/67 C |
| 1,785,194 | 12/1930 | Hammerly | 200/15 |
| 2,542,088 | 2/1951 | Krieger | 200/70 X |
| 2,771,520 | 11/1956 | Stevens | 200/255 X |
| 3,301,971 | 1/1967 | Johnson | 200/11 B |

*Primary Examiner*—A. T. Grimley
*Assistant Examiner*—Morris Ginsburg
*Attorney, Agent, or Firm*—Charles Hieken

[57] ABSTRACT

A snap-action switch includes a housing having a pair of terminal studs at the rear connected to stationary contact blades inside the housing located in a common plane. A pair of rotatable contact blades are supported upon a contact shaft that is rotatable in the housing and attached to a contact shaft driving insulator. A pair of coil springs around the switching shaft urge the rotatable blades together. The driving insulator is formed with notches for engagement with tabs extending from a saddle that is rotatable about a key shaft and adjacent to a cam plate driven by the key shaft. A pair of latching springs cantilevered from respective stop pins in the housing engage respective tangs on the saddle when the saddle is in a corresponding one of the two stable switch positions. An action spring around the keying shaft between the contact shaft driving insulator and the saddle plate has its ends extending through arcuate grooves in the saddle and cam plate. Rotating the key shaft angularly displaces the cam plate while the saddle plate remains stationary to wind the action spring until a cam on the cam plate displaces the latching spring to release the tang on the saddle plate, allowing the spring to unwind and angularly displace the saddle plate, contact shaft driving insulator, contact shaft and rotatable contact blades to the new stable position.

7 Claims, 8 Drawing Figures

HIGH CURRENT SWITCHING

The present invention relates in general to a high current switch and more particularly concerns novel apparatus and techniques for carrying and switching hundreds of amperes. The invention is especially useful as a master switch for heavy construction machinery.

A typical prior art master switch for heavy construction machinery comprises butt contacts actuated by balls riding on ramps. A problem with these switches is that arcing can occur, welding the contacts so that the switch is destroyed, disabling the heavy construction machinery. The economic losses resulting from idleness of a highly paid operator and the costly machinery he operates is a serious problem that has plagued manufacturers of heavy machinery.

Accordingly, it is an important object of this invention to provide improved high current switching.

It is another object of the invention to achieve the preceding object while preventing an operator from pulsing a heavy equipment starter motor.

It is another object of the invention to achieve one or more of the preceding objects while minimizing arcing and contact welding.

It is still a further object of the invention to achieve one or more of the preceding objects while reducing arcing when the heavy machinery vibrates.

It is still a further object of the invention to achieve one or more of the preceding objects while providing self-cleaning action for the contacts.

It is still a further object of the invention to achieve one or more of the preceding objects while providing large contact area to help keep current density and resistance low.

It is still a further object of the invention to achieve one or more of the preceding objects with a switch that may be operated over an exceptionally high number of cycles without significant deterioration.

It is still another object of the invention to achieve one or more of the preceding objects with compact structure that may be conveniently manufactured.

According to the invention, there are first and second blade contact means selectively engageable with third blade contact means relatively rotatable about an axis that is fixed relative to the first and second contact means. Preferably, the third blade contact means comprises first and second axially spaced conducting blades that selectively engage and sandwich the first and second blade contact means. Preferably, the third blade contact means is actuated by action spring means mounted on keying shaft means that provide a snap action angular displacement of the third blade contact means. There is action spring winding means actuated by an operator for winding the action spring means and means for releasing the stored energy in the spring means when the operator advances the action spring winding means a predetermined angular increment. Latching spring means prevents cam means from releasing the energy stored in the action spring means until the cam means engages the latching spring means.

Numerous other features, objects and advantages of the invention will become apparent from the following specification when read in connection with the accompanying drawing in which.

Figure 1:
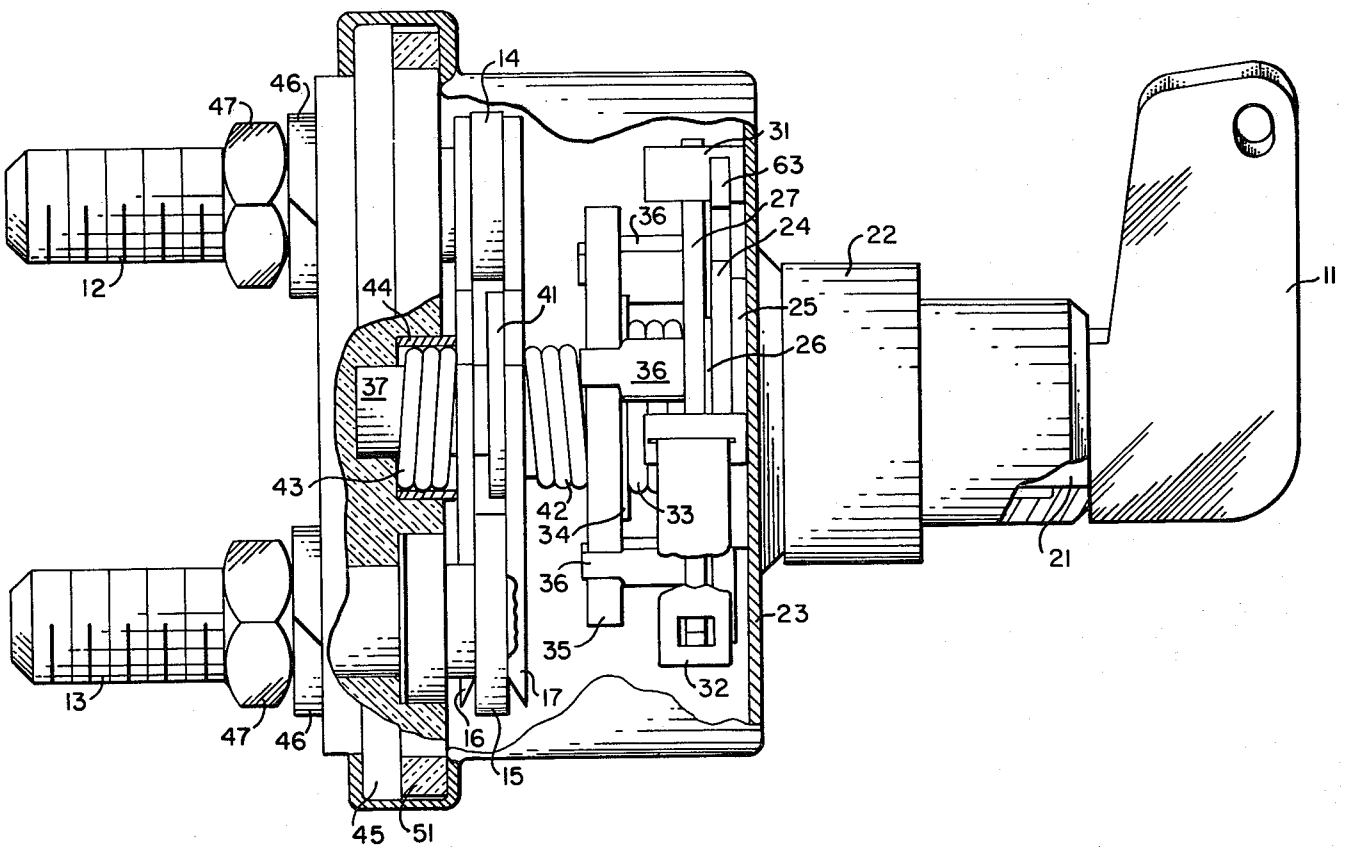
FIG. 1 is a side view of an embodiment of the invention with portions of the housing cut away and partially in section to illustrate features of the invention.
Figures 2, 3:
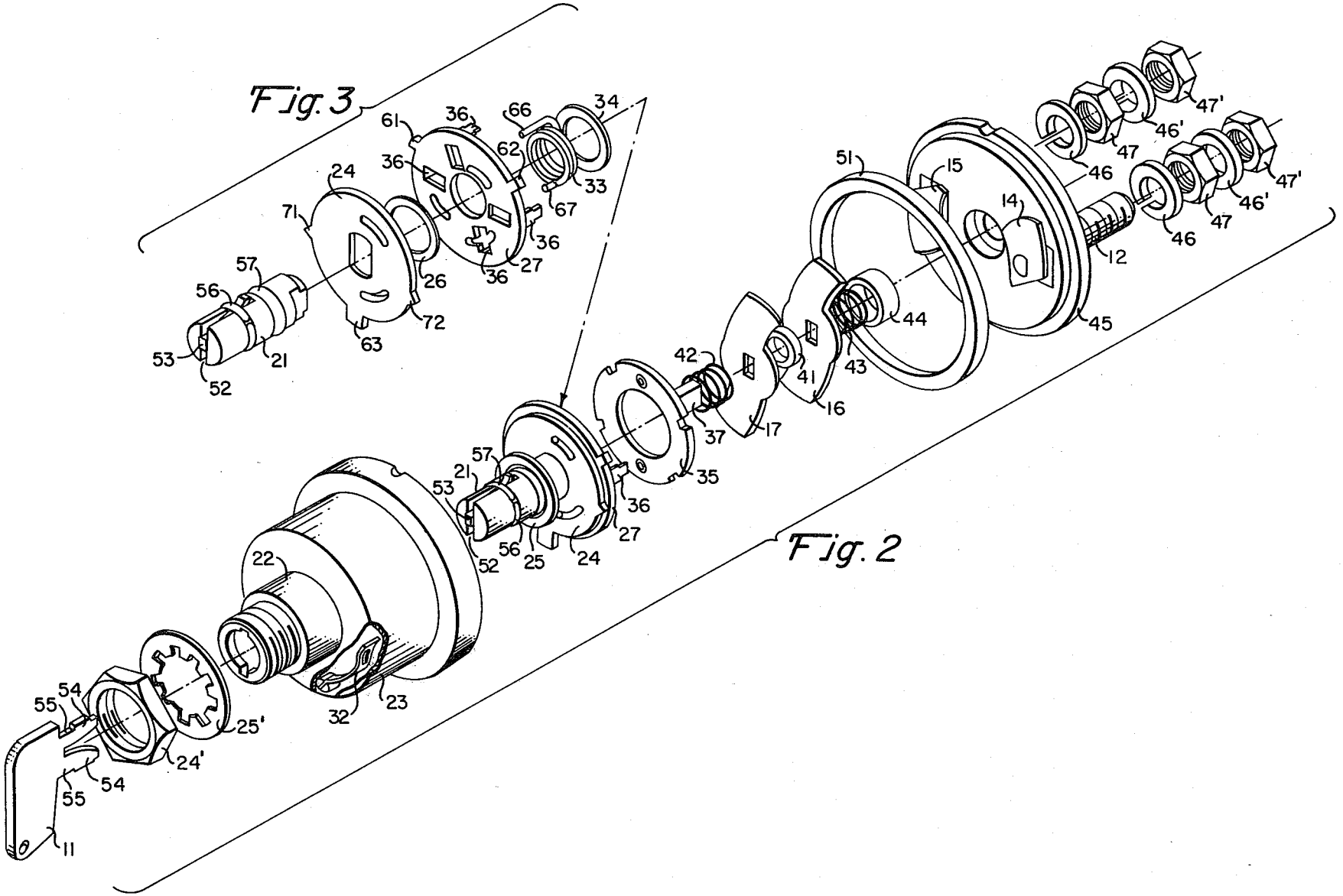
FIG. 2 is an exploded view of the embodiment of FIG. 1.
FIG. 3 is an exploded view of the shaft and saddle subassembly of FIG. 2.

With reference now to the drawing and more particularly FIGS. 1–3 thereof, there is shown in FIG. 1 a side view of an embodiment of the invention with a portion of the housing cut away and partially in section, in FIG. 2 an exploded view of this embodiment and in FIG. 3 an exploded view of the shaft and saddle subassembly. Moving key 11 clockwise and counterclockwise interrupts and completes the electrical current path between terminals 12 and 13 connected to stationary contact blades 14 and 15 through rotating contact blades 16 and 17 which selectively engage and sandwich fixed blades 14 and 15. Key 11 snaps into a key shaft 21 partially surrounded by a bushing 22 that is welded to housing 23. A hex nut 24′ (FIG. 2) and abutting lock washer 25′ are screwed to threaded bushing 22. Threaded bushing 22 is used to install the switch in a panel of heavy equipment.

Figure 4:
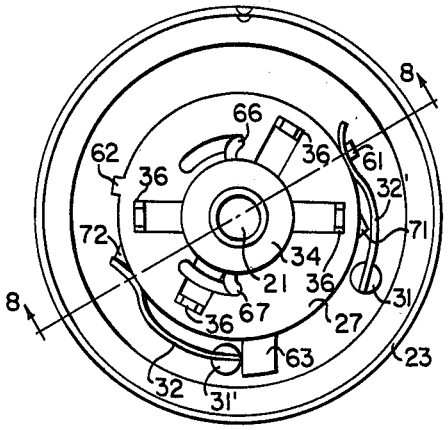
FIG. 4 is a plan view essentially of the shaft and saddle subassembly of FIG. 3 in the housing which with similar views in FIGS. 5–7 help illustrate the mode of operation of the invention.

Inside housing 23 there is a cam plate 24 mounted on and rotated by key shaft 21 and sandwiched between spacers 25 and 26. Cam plate stop 63 rests against a stop pin 31 secured to housing 23 for limiting travel. A saddle 27 shown in FIG. 4 is shown locked from rotation about key shaft 21 by latching spring 32. Action spring 33 on key shaft 21, is wound as key 11 rotates shaft 21 and cam plate 24 as described below in connection with FIGS. 4–7. A spacer 34 retains action spring 33 on shaft 21. Insulator 35 is notched around its periphery for engaging spaced tabs 36 extending axially from saddle 27. Insulator 35 carries contact shaft 37 to which rotatable contacts 16 and 17 are fixed with spacer 41 separating them.

Inner contact spring 42 and outer contact spring 43 surrounded by spacing collar 44 urge rotatable sliding contacts 16 and 17 together and in contact with stationary blade contacts 14 and 15.

A terminal insulator 45 is formed with openings for accommodating terminals 12 and 13 and contact shaft 37. Lock washers 46 and hex nuts 47 keep terminals 12 and 13 secured to contact insulator 45 which abuts gasket 51. A second set of lock washers 46′ and nuts 47′ may be used to establish good contact between an external wire compressed between a lock washer 46′ and a hex nut 47.

Referring more specifically to FIG. 3, there is shown an exploded view of the key shaft and saddle assembly showing additional structural features. Key shaft 21 is formed with a slot 52 for accommodating a spring 53 urged inward by the tangs 54 of key 11 notched at 55 for receiving locking spring 56 to firmly secure key 11 to key shaft 21. Key shaft 21 also is formed with an annular groove that accommodates O-ring 57.

Referring to FIG. 4, there is shown a plan view looking toward key 11 of the shaft and saddle assembly seated in the housing and associated structure helpful in understanding the mode of operation. Saddle 27 is formed with tangs 61 and 62 for capture by openings in latching springs 32′ and 32, respectively. In FIG. 4 latching spring 32′ is shown capturing tang 61 while cam plate tab 63 abuts stop pin 31′. The upper end 66 of action spring 33 and the lower end 67 are in arcuate slots of cam plate 24 and saddle 27. Cams 71 and 72 on cam plate 24 are then not contacting latching springs 32′ and 32.

Figure 5:
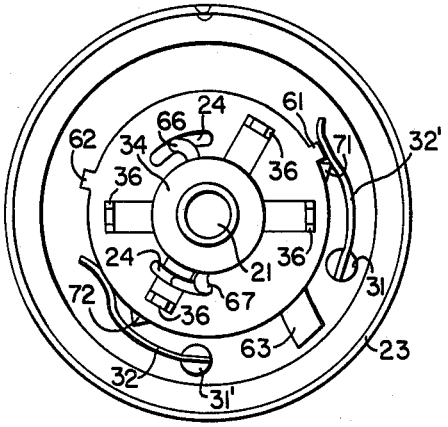
Figure 6:
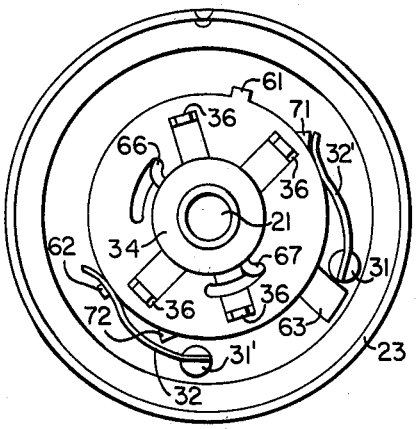

Referring to FIG. 5, there is shown the changed position of elements as key 11 rotates key shaft 21 counterclockwise toward a new position. Cam plate 24 has moved counterclockwise to move end 66 of action spring 33 in the same direction while end 67 is held stationary by the counterclockwise edge of the arcuate groove in saddle 27, thereby winding action spring 33. Cam 71 lifts the edge of latching spring 32′ to release tang 61 and thereby allow action spring 33 to unwind and allow the end 67 to urge saddle 27 counterclockwise until cam plate tab 63 engages stop pin 31 and latching spring 32 engages tang 62 as shown in FIG. 6. This angular displacement of saddle 27 produces a corresponding displacement in contact shaft driving insulator 35 and contact shaft 37 to correspondingly angularly displace rotatable contact blades 16 and 17.

Figure 7:
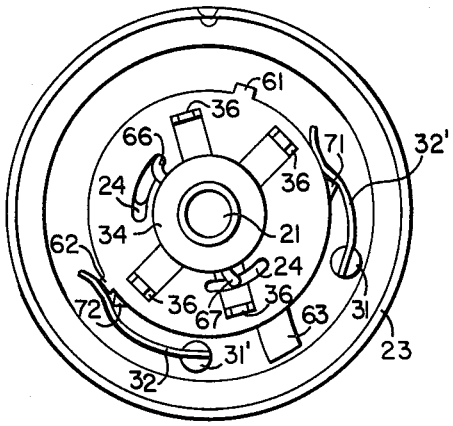
Figure 8:
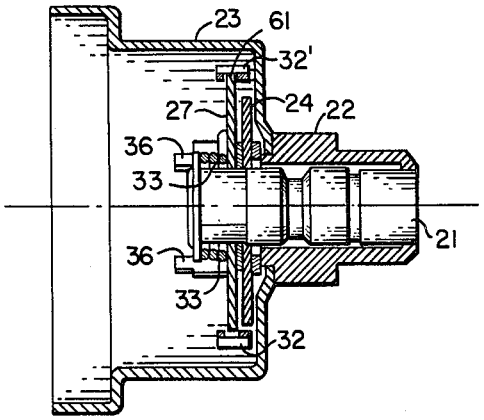
FIG. 8 is a sectional view through section 8—8 of the structure of FIG. 4 helpful in understanding the relationship of the elements which produce snap action actuation of the rotating contact blades.

Referring to FIG. 7, there is shown the transitional positions for rotation of key shaft 21 and key 11 in the clockwise direction. The clockwise edge of the arcuate slot of saddle 27 in which the upper end 66 of action spring 33 resides keeps that end stationary while the counterclockwise edge of the arcuate groove in cam plate 24 in which lower end 67 resides displaces that end clockwise to wind action spring 33 while cam 72 displaces the free edge of latching spring 32 to release tang 62 and allow action spring 33 to unwind with its end 66 moving saddle 27 clockwise to the position shown in FIG. 4. Tabs 36 transmit this angular displacement to contact shaft driving insulator 35 and contact shafft 37 to restore them to the position they attained with the elements as shown in FIG. 4.

The invention has a number of advantages. One of the possible causes of welding with prior art butt contacts may be mechanical vibration of the heavy equipment intermittently interrupting the contacts slightly to produce some arcing which eventually results in contact welding. The present invention avoids this problem because springs 42 and 43 keep rotatable contact blades 16 and 17 in firm engagement with fixed blades 14 and 15. Furthermore, if the vibration is so great that the edges of blades 16 and 17 move axially, forces tending to move one of blades 16 and 17 away from blades 14 and 15 tend to move the other of blades 16 and 17 toward blades 14 and 15 so that an arc-free conducting path is always maintained between studs 12 and 13, even in the presence of severe vibration. Furthermore, the snap and wiping action provides a self-cleaning action and prevents an operator from using the switch for pulsing.

There has been described novel apparatus and techniques for switching high currents over many cycles while maintaining the desired electrical and mechanical characteristics, even in the presence of severe vibrations. It is evident that those skilled in the art may now make numerous uses and modifications of and departures from the specific embodiment described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Switching apparatus comprising, first and second insulatedly separated blade contact means of conducting material, third blade contact means of conducting material relatively rotatable with respect to an axis about which said first and second blade contact means are located in fixed relationship, means for relatively angularly displacing said third blade contact means relative to said first and second contact blade means about said axis in a plane perpendicular to said axis and parallel to the planes of all said blade contact means to selectively interconnect said first and second blade contact means with said third blade contact means with said blade contact means upon interconnection being in dovetailing relationship, action spring means having first and second ends and surrounding said axis for selectively storing and releasing mechanical rotating energy for selectively displacing said third blade contact means with snap action only upon release of the stored energy, key shaft means for providing torque for winding said action spring means to store potential energy therein by rotating one of said first and second ends about said axis while the other remains stationary about said axis, means including cam means concentric about said axis rotated by said key shaft means and latch spring means responsive to said key shaft means being displaced a predetermined angle about said axis to actuate said latch spring means with said cam means for releasing the potential energy stored in said action spring means by releasing the previously stationary one of said first and second ends while the previously rotating one remains stationary, and means for coupling the torque provided by said action spring means upon releasing said potential energy to said third blade contact means for angularly displacing the latter.

2. Switching apparatus in accordance with claim 1 wherein said first and second blade contact means each comprise a conducting blade in a common plane and said third blade contact means comprises first and second axially spaced conducting blades separated by a distance corresponding substantially to the thickness of the blades of said first and second blade contact means for sandwiching said blades in said common plane and establishing good electrical contact between said first and second blade contact means through said first and second conducting blades.

3. Switching apparatus in accordance with claim 2 and further comprising, housing means for supporting said first and second blade contact means in fixed relationship thereto, contact shaft means rotatably supported in said housing means for rotation about said axis and supporting said first and second blades for angular displacement about said axis, and spring means about said contact shaft means for urging said first and second blades together and in good contact with the blades in said common plane.

4. Switching apparatus in accordance with claim 1 and further comprising, a cam plate mounted on and driven by said key shaft means, a saddle rotatably supported about said key shaft means formed with tabs extending generally parallel to said key shaft means, said saddle being adjacent to said cam plate and having a pair of tangs angularly spaced about the key shaft means axis, a housing, a pair of stop pins angularly spaced about the key shaft means axis extending from said housing, a pair of latching springs cantilevered from respective ones of said stop pins for engaging respective ones of said tangs on said saddle when said saddle is in a corresponding one of two stable switch positions, said cam plate and said latching springs being located in a common plane whereby rotation of said key shaft means rotates said cam plate to release one of said latching springs from engagement with a tang on said saddle after a predetermined angular displacement to release the mechanical energy stored in said action spring means.

5. Switching apparatus in accordance with claim 4 wherein the means for coupling the torque provided by said action spring means comprises a driving insulator formed with notches engaging said tabs extending from said saddle and secured to said means for relatively angularly displacing said third blade plate contact means relative to said first and second blade contact means.

6. Switching apparatus in accordance with claim 5 wherein said means for relatively angularly displacing said third blade contact means relative to said first and second blade contact means comprises a switching shaft rotatably supported in said housing and having its axis coextensive with that of said key shaft means and carrying said third blade contact means.

7. Switching apparatus in accordance with claim 1 wherein said cam means comprises a cam plate with first and second cams angularly displaced about said axis, said latch spring means comprising first and second latching springs angularly displaced about said axis, and means for coupling said first and second latching springs to said first and second ends respectively, whereby actuation of a latching spring by one of said cams releases the associated one of said first and second ends.

* * * * *